US007814622B2

(12) United States Patent
Leger

(10) Patent No.: US 7,814,622 B2
(45) Date of Patent: Oct. 19, 2010

(54) DEVICE FOR COMPACTING FIBER FLOCKS

(75) Inventor: Joachim Leger, Eberbach (DE)

(73) Assignee: Oskar Dilo Maschinenfrabrik KG (DE)

( * ) Notice: Subject to any disclaimer, the term of this patent is extended or adjusted under 35 U.S.C. 154(b) by 127 days.

(21) Appl. No.: 12/203,491

(22) Filed: Sep. 3, 2008

(65) Prior Publication Data

US 2009/0064464 A1 Mar. 12, 2009

(30) Foreign Application Priority Data

Sep. 6, 2007 (EP) ..... 07017492

(51) Int. Cl.
*D01G 15/40* (2006.01)

(52) U.S. Cl. ..... 19/105; 19/296

(58) Field of Classification Search ..... 19/105, 19/296, 300

See application file for complete search history.

(56) References Cited

U.S. PATENT DOCUMENTS 4,387,486 A * 6/1983 Keller et al. ..... 19/105
4,476,611 A 10/1984 Keller et al.
4,510,647 A 4/1985 Keller et al.
4,520,530 A * 6/1985 Pinto ..... 19/105
4,657,444 A * 4/1987 Pinto ..... 406/23
4,694,538 A * 9/1987 Pinto et al. ..... 19/105
5,297,316 A * 3/1994 Bernhardt et al. ..... 19/105
5,913,393 A * 6/1999 Shaltry et al. ..... 19/97.5
5,950,282 A * 9/1999 Pinto ..... 19/97.5
6,360,403 B1 * 3/2002 Rubenach ..... 19/97.5
6,460,223 B1 * 10/2002 Pinto ..... 19/105
2002/0116792 A1 8/2002 Pinto

FOREIGN PATENT DOCUMENTS

DE 953 587 12/1956
DE 33 36 654 4/1985
DE 40 41 259 7/1991
EP 0 529 246 3/1996

* cited by examiner

*Primary Examiner*—Shaun R Hurley
(74) *Attorney, Agent, or Firm*—Jansson Shupe & Munger Ltd.

(57) ABSTRACT

A device for compacting fiber flocks into a flock mat has means for supplying the fiber flocks, a discharge belt for carrying the compacted flock mat away, and walls, which are arranged opposite each other between the means for supplying the fiber flocks and the discharge belt and thus form the boundaries of an essentially vertical chute feed, which defines the transport direction of the fiber flocks. At least one of the walls is supported in such a way that its movement during each cycle has a component in the transport direction of the fiber flocks and a component in the direction transverse to the transport direction.

11 Claims, 1 Drawing Sheet

DEVICE FOR COMPACTING FIBER FLOCKS

CROSS REFERENCE TO RELATED APPLICATION

This application claims priority based on European patent application EP 07 017 492.5, filed Sep. 6, 2007.

FIELD OF THE INVENTION

The invention relates to devices and methods for compacting fiber flocks and more specifically to devices for compacting fiber flocks to form fiber flock mats.

BACKGROUND

Devices for compacting fiber flocks are usually designed as hopper-type feeds such as vibrating chute feeds. These feeds compact the flock-like fibers into a flock mat, which is then sent to, for example, a fleece forming system. Devices for compacting fiber flocks are known from, for example, EP 0 529 246 B1, DE 195 38 143 C2, and DE 299 24 648 U1.

These devices suffer from the disadvantages that the fiber flocks are often compacted in irregular fashion and that the compaction can be controlled to only a limited extent by adjustment of the machine parameters.

SUMMARY OF THE INVENTION

It is an object of the present invention to provide a device for compacting fiber flocks into a flock mat, by means of which a uniformly dense flock mat can be produced very quickly.

According to an aspect of the invention, the device for compacting fiber flocks into a flock mat comprises a means for supplying the fiber flocks, a discharge belt for carrying the compacted flock mat away, and two walls arranged opposite each other between the means for supplying the fiber flocks and the discharge belt. The two walls form the boundaries of an essentially vertical chute feed, which defines the transport direction of the fiber flocks. At least one of the walls is supported in such a way that its movement during each cycle comprises a component in the transport direction of the fiber flocks and a component in the direction transverse to that transport direction.

With this arrangement, it is possible not only to move the flocks downward through the chute feed by means of vibratory movement but also to accelerate the compaction process by the guided movement of at least one wall, which moves first inward and then downward. This guarantees continuous deposition onto the discharge belt.

Both walls are preferably supported in such a way that, during each cycle, they can move in a predetermined manner, this movement comprising a component in the transport direction of the fiber flocks and a component transverse to that. As a result of this coordinated, synchronized movement, the compacting effect in the direction toward the discharge belt is increased.

To improve the discharge of the compacted fiber flocks, the two walls are slightly offset from each other in the transport direction by the use of two offset discharge rollers at the bottom end of the vertical chute feed.

In a preferred embodiment, the upper area of at least one wall is supported pivotably on an upper cam arrangement. As a result, the direction in which the wall moves, namely, in the transport direction of the fiber flocks and also transversely thereto, is defined in a simple manner. Similarly, the lower area of at least one wall is rigidly supported on a lower cam arrangement. In addition, the upper cam arrangement preferably comprises a longer stroke than the lower cam arrangement, as a result of which an elliptical movement is produced in the upper area of the wall, whereas only a circular movement is generated in the lower area.

In one embodiment, the upper cam arrangement includes a stationary but rotating upper shaft, which drives an upper cam disk rigidly connected to the upper shaft. The upper cam arrangement also includes an upper con rod, which is connected rotatably at one end to the upper cam disk and at the other end pivotably to the respective wall by way of a connecting pin permanently connected to the upper con rod.

In an other embodiment, the lower cam arrangement comprises a stationary but rotating lower shaft, which drives a lower cam disk rigidly connected to the lower shaft, and a lower con rod, which is connected at one end to the lower cam disk and at the other end rigidly to the wall.

To achieve the different types of strokes mentioned above, the upper cam arrangement is preferably designed in a similar manner, wherein the diameter of the cam disk is appropriately larger, and the upper con rod is connected pivotably to the wall by a connecting pin permanently connected to the upper con rod.

In this arrangement, the upper cam arrangement and the lower cam arrangement are connected to each other so that their movements can be synchronized It is also contemplated that the cam arrangements of the two walls have different phase positions to allow alternative movement. In an especially highly developed embodiment, a control unit is provided, which serves to coordinate or otherwise modify the movements of all the cam arrangements of the device with each other. As a result, standard sequences can be predefined, but it is also possible, for example, to adjust the rotational speed of the camshafts as appropriate in response to the results of a weight measurement of the flock mat which has been produced.

BRIEF DESCRIPTION OF THE DRAWINGS

Additional features and advantages of the present invention can be derived from the following description, which refers to the drawing.

DETAILED DESCRIPTION OF THE INVENTION

Figure 1:
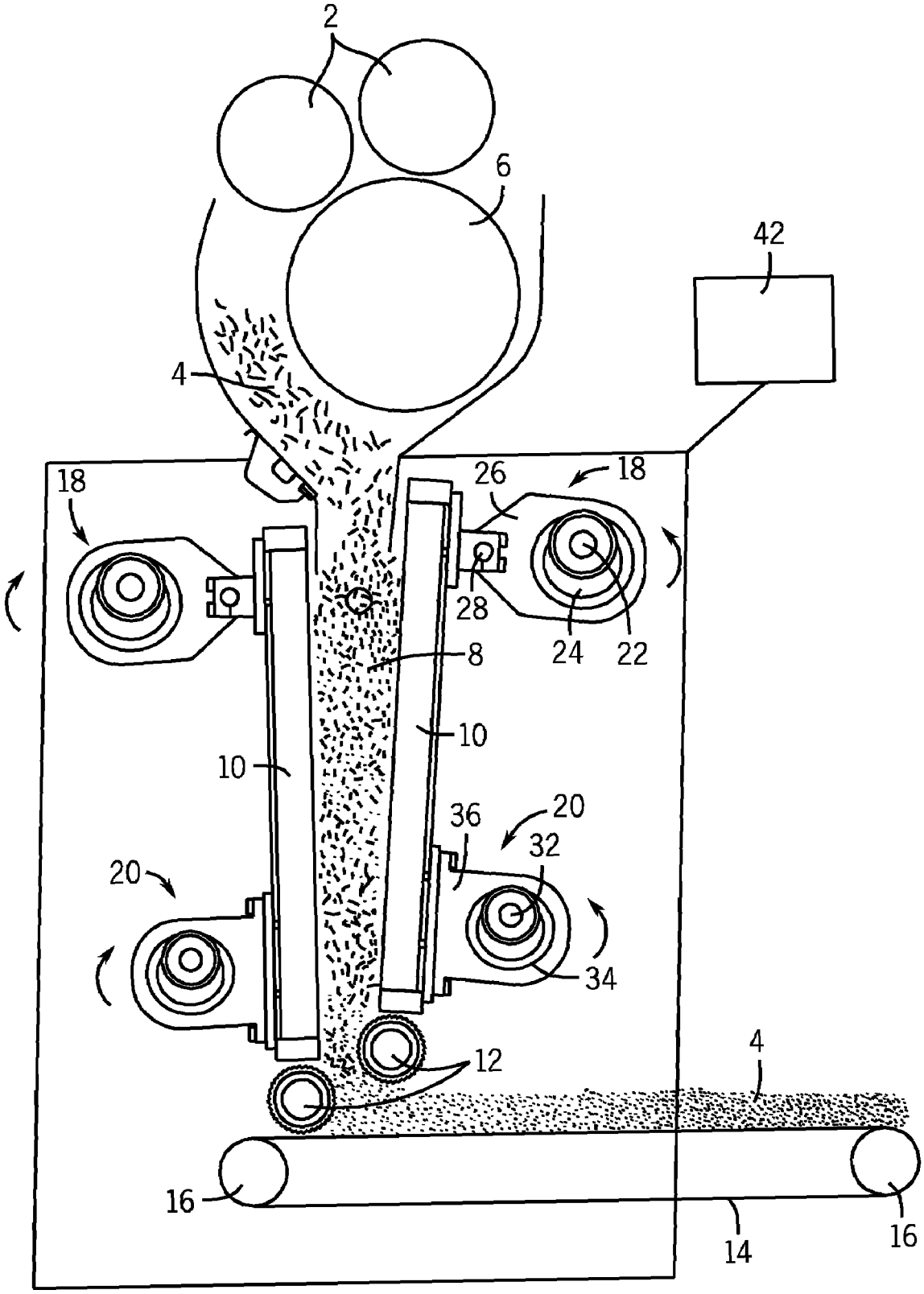
FIG. 1 is a schematic side view of an embodiment of the inventive device for compacting fiber flocks.

FIG. 1 shows an inventive device for compacting fiber flocks, which is designed as a chute feed. The device comprises two feed rollers 2, which are driven in opposite directions and convey the fiber flocks 4 through the gap between the two feed rollers 2. Underneath the gap, an opening roller 6 is installed, which is designed as a stripping roller which may include projecting pins or the like. Fiber flocks 4 stripped by opening roller 6 arrive in a chute feed 8, which is formed by two essentially vertical, opposing walls 10. At the bottom end of the chute feed 8, two discharge rollers 12 are arranged a certain distance apart and slightly offset in height from each other. Discharge rollers 12 are driven in opposite directions and send the already compacted flock material 4 through the gap between discharge rollers 12 onto a discharge belt 14, which runs over two deflecting rollers 16. As shown in the drawing, fiber flocks 4 conveyed onto the discharge belt 14 have already been compacted into a mat, which is sent onward for further processing in, for example, a carding machine.

In the example shown here, the two walls 10 of the chute feed are each connected at the top to an upper cam arrangement 18 and at the bottom to a lower cam arrangement 20. Upper cam arrangement 18 has a stationary but rotating upper shaft 22, which drives an upper cam disk 24 connected rigidly to upper shaft 22. In addition, upper cam arrangement 18 has an upper con rod 26, which is connected to upper cam disk 24 preferably by way of a ball bearing (not shown). Upper con rod 26 is connected to wall 10 through a connecting pin 28 thereby creating a pivotable connection between upper con rod 26 and wall 10.

In a similar manner, lower cam arrangement 20 comprises a stationary lower shaft 32, which is connected rigidly to a lower cam disk 34. Lower con rod 36 is also installed around, and connected to, the lower cam disk 34 preferably by way of a ball bearing at one end. At the other end, Lower con rod 36 is rigidly connected to a corresponding section of wall 10. Upper shaft 22 and lower shaft 32 are driven in the same direction and thus move wall 10 by way of upper cam arrangement 18 and lower cam arrangement 20 along an essentially orbiting path with one component in the transport direction of the fiber flocks, i.e., vertically downward in the present example, and with one component transverse to the transport direction of fiber flocks 4, that is, in such a way as to narrow the width of chute feed 8. The shafts of the other wall rotate in the opposite direction.

Because the diameter of the upper cam disk 24 is larger than that of lower cam disk 34, and because upper cam arrangement 18 is pivotably supported on wall 10, wall 10 can execute a longer transverse stroke at upper cam arrangement 18 than it does at lower cam arrangement 20. As a result, flock material 4 is particularly loose near cam arrangement 18 and is pressed together over a greater transverse distance as it passes into the lower area of chute 8 near cam arrangement 18. Accordingly, greater compaction of fiber flocks 4 may be achieved as fiber flock 4 moves through chute feed 8 from an area near cam arrangement 18 toward cam arrangement 20. This effect can be intensified by narrowing chute feed 8 in the bottom area by having walls 10 slant toward each other.

Because walls 10 are preferably designed as perforated plates, and can include a set of small, downward-pointing shingles or pointed members, the component of the cam movement acting in the transport direction of fiber flocks 4 can achieve or intensify the ability of walls 10 to carry fiber flocks 4 through chute feed 8. Such movement also provides the ability to compact fiber flocks 4 vertically in the direction toward the outlet of chute feed 8.

Although a specific embodiment of the invention has been described in detail on the basis of the present example, various alternative designs or modifications are also possible. For example, chute feed 8 can also be slanted; two cam disks 24 and 34 can be of the same size; and only one of walls 10 can be movable, the other being stationary. There are also various ways in which cam arrangements 18 and 20 can be designed, as will be obvious to the expert. The important point in all cases is the possibility of a cyclical movement, which comprises both a component in the transport direction of fiber flocks 4 through chute feed 8 and a component transverse to that direction of movement of fiber flocks 4. For this purpose, it is possible to use circular movements, elliptical movements, or even rectangular movements.

In the present example, an elliptical movement is obtained for upper wall area 10, whereas the lower wall area 10 executes a circular movement. Here, too, many different modifications are possible. Two cam arrangements 18, 20 can easily comprise other types of eccentricities and can be in different phase positions with respect to each other in preferred embodiments.

In a one such design, upper shaft 22 and lower shaft 32 are connected, for example, by chains or toothed belts. It is also possible and contemplated herein for each shaft to have its own separate drive.

It may be advantageous to provide a control unit 42, which controls shafts 22, 32 and which can also be responsible for control of the movement of the discharge rollers 12, feed rollers 2, and opening roller 6 in unison or independently based on the desired application and particular specifications of use. As a result, it is easy to influence the density of flock mat 4 thus produced. When an automatic control circuit is provided to correct for variations in weight, the weight of the flock mat which has been produced can be measured in any desired way, and this value can be used by the control unit to set or to adjust any of above parameters both before and during use of the compacting device.

The present invention therefore makes it possible to improve the production of flock mats in a simple cost effective manner.

While the invention is shown in several forms, it is not limited to those embodiments illustrated, but is susceptible to various changes and modifications without departing from the spirit and scope of the invention.

What is claimed is:

1. A device for compacting fiber flocks to form a flock mat, comprising:

means for supplying the fiber flocks;

a discharge belt for carrying away the compacted flock mat; and two walls, which are arranged opposite each other between the means for supplying the fiber flocks and the discharge belt and thus form the boundaries of an essentially vertical chute feed, which defines a transport direction of the fiber flocks, wherein at least one of the walls is movable in cycles, and wherein at least one of the walls is supported in such a way that the movement which it executes during each cycle comprises a component transverse to the transport direction of the fiber flocks in combination with a component in the transport direction of the fiber flocks to compact the fiber flocks vertically.

2. The device of claim 1 wherein both walls are supported in such a way that the movement which they execute during each cycle comprises a component in the transport direction of the fiber flocks and a component transverse to that.

3. The device of claim 2 wherein the walls are slightly offset from each other in the transport direction.

4. The device of claim 1 wherein the upper area of at least one wall is pivotably supported on an upper cam arrangement.

5. The device of claim 4 wherein the lower area of at least one wall is supported rigidly on a lower cam arrangement.

6. The device of claim 5 wherein the upper cam arrangement has a longer stroke than the lower cam arrangement.

7. The device of claim 4, wherein the upper cam arrangement comprises a stationary but rotating upper shaft, which drives an upper cam disk rigidly connected to the upper shaft, and an upper con rod, which is connected rotatably at one end to the upper cam disk and at the other end pivotably to the respective wall by way of a connecting pin permanently connected to the upper con rod.

8. The device of claim 7 wherein the lower area of at least one wall is supported rigidly on a lower cam arrangement, which comprises a stationary but rotating lower shaft, which drives a lower cam disk rigidly connected to the lower shaft, and a lower con rod, which is connected rotatably at one end to the lower cam disk and at the other end rigidly to the respective wall.

9. The device of claim 8 wherein the upper cam arrangement and the lower cam arrangement are connected to each other for the purpose of synchronized movement.

10. The device of claim 9 wherein a control unit is provided, which serves to coordinate the movements of all the cam arrangements of the device.

11. The device of claim 5 wherein the cam arrangements of the two walls have different phase positions.

* * * * *